US006098968A

United States Patent [19]

Workman

[11] Patent Number: 6,098,968

[45] **Date of Patent: *Aug. 8, 2000**

[54] POCKETED SPRING ASSEMBLY

[75] Inventor: Joe C. Workman, Carthage, Mo.

[73] Assignee: L&P Property Management Company, South Gate, Calif.

[ * ] Notice: This patent is subject to a terminal disclaimer.

[21] Appl. No.: 09/332,699

[22] Filed: Jun. 14, 1999

Related U.S. Application Data

[60] Division of application No. 09/119,572, Jul. 20, 1998, Pat. No. 6,036,181, which is a continuation-in-part of application No. 09/039,807, Mar. 16, 1998, Pat. No. 5,957,438

[60] Provisional application No. 60/073,633, Feb. 4, 1998.

[51] Int. Cl.[7] ..... A47C 27/04; A47C 27/06

[52] U.S. Cl. ..... 267/90; 5/655.8; 5/720; 5/716; 5/727

[58] Field of Search ..... 5/655.8, 655.7, 5/720, 727, 716; 267/90, 91, 94; 53/114; 112/475.08; 29/91, 91.1, 451

[56] References Cited

U.S. PATENT DOCUMENTS

| | | | |
|---|---|---|---|
| 1,153,120 | 9/1915 | Lackey . | |
| 1,269,018 | 6/1918 | Stevens . | |
| 1,434,653 | 11/1922 | Fiss et al. . | |
| 1,502,510 | 8/1924 | Marcus et al. . | |
| 1,602,197 | 10/1926 | Kramer | 5/655.8 |
| 1,663,272 | 3/1928 | Kellar | 5/655.8 |
| 1,683,684 | 9/1928 | MacInerney . | |
| 1,724,947 | 8/1929 | Macinerney . | |
| 3,230,558 | 1/1966 | Duncan . | |
| 3,855,653 | 12/1974 | Stalter, Sr. . | |
| 4,053,956 | 10/1977 | Higgins . | |
| 4,112,726 | 9/1978 | Adams et al. . | |
| 4,234,983 | 11/1980 | Stumpf . | |
| 4,234,984 | 11/1980 | Stumpf . | |
| 4,523,344 | 6/1985 | Stumpf et al. . | |
| 4,854,023 | 8/1989 | Stumpf . | |
| 4,907,309 | 3/1990 | Breckle . | |
| 4,942,636 | 7/1990 | Scott et al. . | |
| 4,985,952 | 1/1991 | Edelson . | |
| 5,027,459 | 7/1991 | Perry, Jr. et al. . | |
| 5,086,529 | 2/1992 | DeGroot . | |
| 5,127,635 | 7/1992 | Long et al. . | |
| 5,438,718 | 8/1995 | Kelly et al. . | |
| 5,669,093 | 9/1997 | Ogle et al. . | |
| 5,761,784 | 6/1998 | Ogle et al. | 29/91.1 |

FOREIGN PATENT DOCUMENTS

| | | | |
|---|---|---|---|
| 1194621 | 3/1982 | Canada . | |
| 089789A1 | 10/1983 | European Pat. Off. . | |
| 421496A1 | 7/1989 | European Pat. Off. . | |
| 357912A1 | 10/1989 | European Pat. Off. . | |
| 2229194 | 12/1974 | France . | |
| 945591 | 6/1956 | Germany . | |
| 3016914A1 | 11/1981 | Germany . | |
| 3831510A1 | 5/1989 | Germany . | |
| 0001247 | of 1904 | United Kingdom . | |
| 0026847 | of 1912 | United Kingdom | 5/655.8 |
| 26847 | of 1912 | United Kingdom | 5/655.8 |
| 318141 | 8/1930 | United Kingdom . | |
| 379029 | 8/1932 | United Kingdom | 5/655.7 |
| 491523 | 9/1938 | United Kingdom | 5/655.8 |
| 759177 | 10/1956 | United Kingdom . | |
| 2143731B | 2/1985 | United Kingdom . | |

*Primary Examiner*—Alexander Grosz
*Attorney, Agent, or Firm*—Wood, Herron & Evans, L.L.P.

[57] ABSTRACT

A spring assembly comprising a plurality of blocks joined together. Each block contains a string of springs. The string of springs comprises a row of springs, an upper fabric retainer and a lower fabric retainer. The row of springs may be a band of springs made from a single length of wire or a plurality of individual springs. The end turns of the springs are located in receptacles created in the fabric retainers.

17 Claims, 9 Drawing Sheets

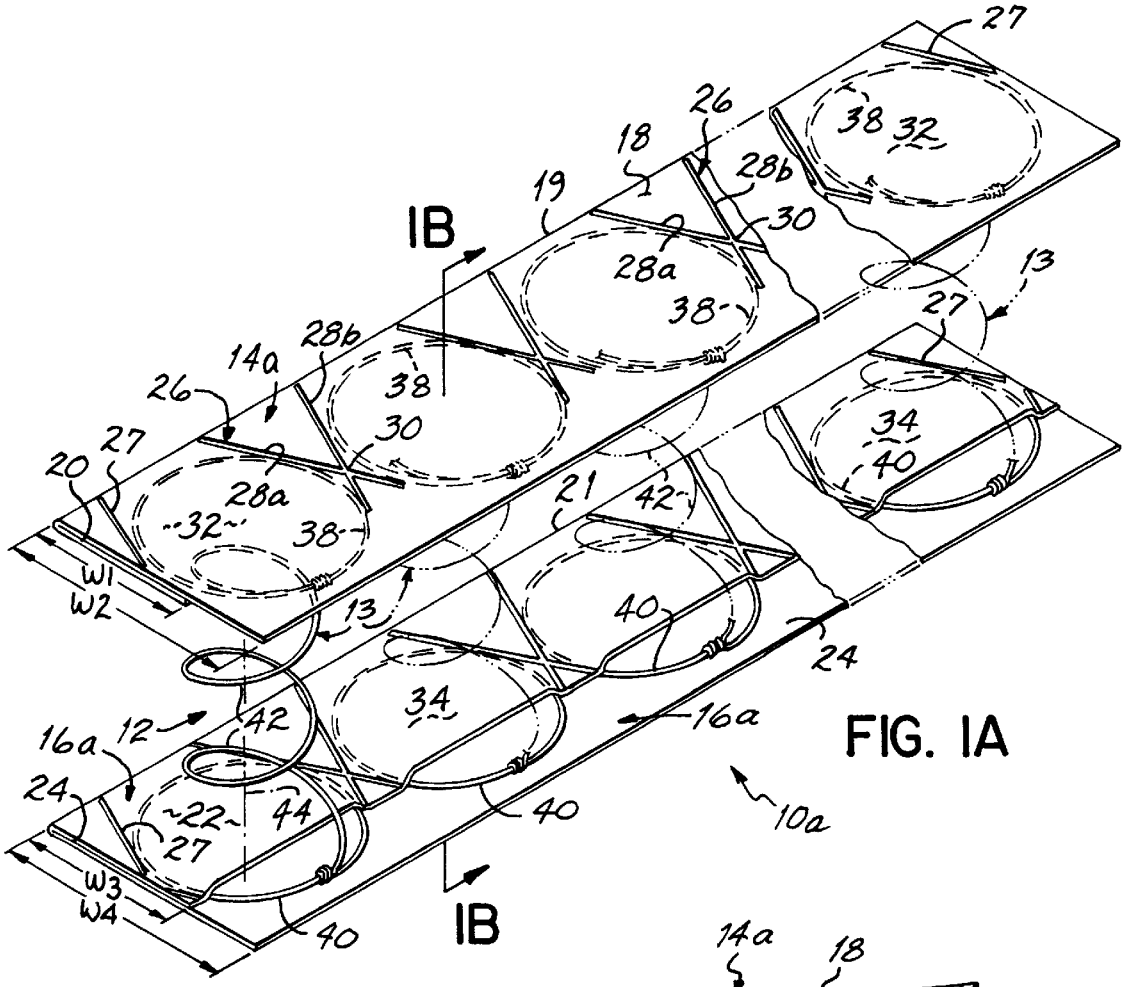
FIG. IA
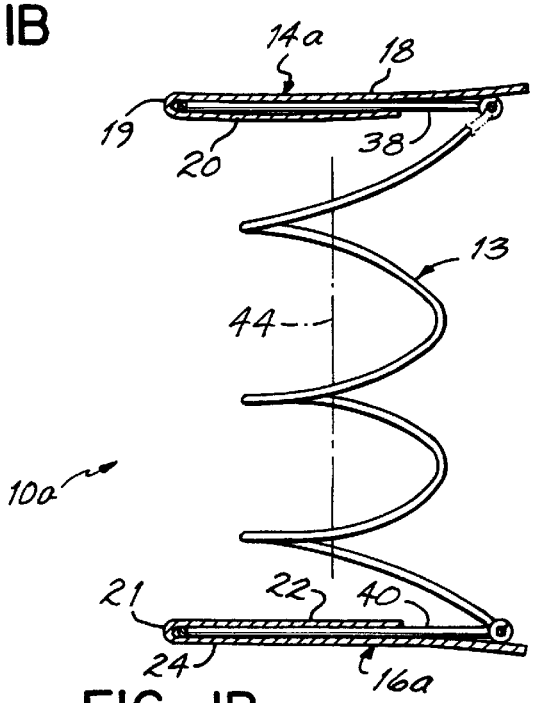
FIG. IB

POCKETED SPRING ASSEMBLY

RELATIONSHIP TO OTHER APPLICATIONS

This application is a divisional application of U.S. patent application Ser. No. 09/119,572 filed Jul. 20, 1998, now U.S. Pat. No. 6,036,181, entitled SPRING ASSEMBLY which is fully incorporated by reference herein. U.S. patent application Ser. No. 09/119,572 is a continuation-in-part application of U.S. patent application Ser. No. 09/039,807 filed Mar. 16, 1998, now U.S. Pat. No. 5,957,438, entitled SPRING RETAINER ASSEMBLY which is fully incorporated by reference herein. U.S. patent application Ser. No. 09/039,807, now U.S. Pat. No. 5,957,438, claims priority to U.S. provisional patent application Ser. No. 60/073,633 filed Feb. 4, 1998 entitled SPRING RETAINER ASSEMBLY which is also fully incorporated by reference herein.

FIELD OF THE INVENTION

This invention relates to spring assemblies for mattresses, cushions and the like and, more particularly, to spring assemblies formed by joining multiple rows of interconnected springs.

BACKGROUND OF THE INVENTION

Traditionally, a spring core for a mattress has comprised a plurality of aligned coil springs, each coil spring having an upper end turn and a lower end turn interconnected by one or more turns or revolutions of the spring. All of the coil springs are of approximately identical height so that all of the upper end turns lie in a common top plane and, similarly, all of the lower end turns lie in a common bottom plane. The spring core typically has a longitudinal dimension and a transverse dimension, the longitudinal dimension being greater than the transverse dimension. The coil springs are aligned in longitudinally extending columns and transversely extending rows. The coils springs are typically joined by helical lacing wires located in the top and bottom planes of the spring core, each helical lacing wire encircling the end turns of adjacent rows or columns of coil springs. Thus, the helical lacing wires may extend either transversely connecting adjacent rows of coil springs or longitudinally connecting adjacent columns of coil springs. Often, a rectangular border wire is located in the top and bottom planes of the spring core and the outermost coil springs clipped or otherwise secured to the border wires.

Alternatively, a mattress spring core may be formed with bands of springs rather than individual coil springs. Each of these bands of springs is formed of a single piece or length of wire formed into a plurality of connected coil springs, each coil spring having an upper end turn and a lower end turn. Adjacent bands of coil springs are again joined by helical lacing wires. Most often these continuous bands of springs extend longitudinally and the helical lacing wires extend transversely of the bands and embrace portions of the bands. Several different kinds of bands of springs have been proposed for incorporation into spring interiors of bedding mattresses. One kind of band which is the subject of British Patent No. 2,143,731 will hereinafter be referred to as a band of interlocked or interlaced springs. In addition, U.S. Patent Nos. 4,053,956 and 4,112,726 disclose bands of springs made of a single length of wire without the convolutions of the coil springs being interlocked or interlaced. In either case, such a band comprises a single length of wire configured to form a plurality of individual coil springs arranged in a row, one end turn of each coil spring lying adjacent to a top face of the band and the other end turn of the coil spring lying adjacent to a bottom face of the band, each coil spring being of a rotational hand either opposite to or of the same rotational hand of the adjacent coils immediately before it in the row and being joined to the adjacent coil springs by a plurality of interconnecting segments of wire integral with the coil springs. One of the pair of interconnecting segments is located in the bottom face of the band and the other of the pair of interconnecting segments is located in the top face of the band.

Regardless of whether a mattress spring core is made of a plurality of aligned individual coil springs or a plurality of interconnected bands of coil springs, the end turns of the coil springs must be connected together in order to maintain the alignment of the coil springs in the spring core. Helical lacing wires, clips, or hog rings are the most common forms of connectors used to connect adjacent end turns of adjacent rows or columns of coil springs. If helical lacing wires are used, a machine is required to apply the helical lacing wires, increasing the cost of the final product.

One well known type of spring interior of a mattress or cushion which does not require helical lacing wires or their equivalent to connect adjacent rows or columns of coil springs is a so called pocketed spring assembly. One type of pocketed spring assembly comprises a plurality of fabric pockets joined together, each pocket containing an individual coil spring. The row of pocketed coil springs may be individual coil springs joined to each other as in U.S. Pat. No. 4,234,983 or a band of springs formed from a single continuous wire as in U.S. Pat. No. 5,127,635. The individual pockets are then joined together as by sewing, welding or adhering to form a pocketed spring assembly.

U.S. Pat. No. 5,669,093 issued to the assignee of the present invention and herein incorporated by reference discloses a plurality of integrally connected fabric tubular blocks, each tubular block containing a band of coil springs. The tubular blocks are connected to each other accordion style by lines of attachment between the individual blocks with successive lines of attachment being located alternately in the upper and lower planar surfaces of the assembly. The method of assembly of such a pocketed product is disclosed in U.S. Pat. No. 5,761,784 which is also incorporated by reference herein.

Another patent which discloses a pocketed spring assembly is U.S. Pat. No. 5,127,635 also issued to the assignee of the present invention. This patent discloses a pocketed coil spring assembly in which longitudinally extending bands of coil springs made of one continuous length of wire are enclosed in fabric covers to form longitudinally extending strips. Within each strip, individual pockets encasing one or more coil springs of a band are formed by connecting opposite sides of the fabric together between the individual coil springs. The fabric pockets are adhesively secured together by conventional adhesive with or without foam pieces inserted between the longitudinally extending strips.

Another known type of spring assembly comprises a plurality of three-sided spring containing strips joined together in order to make a spring assembly. Each strip contains a plurality of individual coil springs placed within a three-sided strip or pocket of fabric, one side of the strip being open. The individual coil springs within the strip are separated from each other by individual fabric partition members which are sewn or otherwise secured to the top and bottom of the three-sided fabric strip. A plurality of strips are aligned and sewn together in order to make the desired size of spring assembly. U.S. Pat. Nos. 1,663,272 and 1,724,948 disclose such spring containing strips and spring assemblies.

One disadvantage to this type of spring assembly is that a separate piece of fabric (partition member) must be sewn between each individual coil spring thus increasing the time and labor costs required to make a strip and an assembly of strips.

British Patent No. 379,029 likewise discloses a plurality of spring containing members joined together in order to make a spring assembly. However, each of these members comprises a pair of fabric strips. One of the strips surrounds the upper end turns of each coil spring of the member and, the other fabric strip encompasses the lower end turns of each coil spring within the member. However, each strip requires a great deal of stitching in both the longitudinal and transverse directions in order to secure the end turns of the coil springs in place.

It has been one objective of the present invention to create a string or row of springs joined together more economically than has heretofore been possible.

It has been another objective of the invention to economically join together a plurality of strings of springs into a spring assembly by securing adjacent fabric retainers to each other.

It has been another objective of the present invention to economically create a string or row of springs by securing a continuous band of coil springs within the string by means of a pair of retainers of fabric material.

It has further been an objective of the present invention to provide a spring assembly in which strings of springs are encased within tubular fabric blocks and multiple blocks joined together to make a spring assembly.

SUMMARY OF THE INVENTION

The invention of this application which accomplishes these objectives comprises a string of springs adapted to be combined with other like strings of springs to form a spring assembly. The string of springs comprises a row of springs, each of the springs having an upper and lower end turn. A pair of fabric retainers joins the springs together in a row. A first fabric retainer has an upper ply and a lower ply. The upper and lower plies are joined to each other by multiple spaced lines of attachment or connections, a pair of adjacent connections defining a receptacle or pocket therebetween adapted to receive one of the end turns of a spring. Likewise, a second fabric retainer has an upper and lower ply, the upper and lower plies being joined by multiple spaced connections such that a pair of adjacent connections define a receptacle or pocket therebetween. Each of the springs is located between the first and second fabric retainers with the end turns of the springs being located within the retainer receptacles or pockets. Preferably, each of the fabric retainers is made of a single piece of fabric folded longitudinally so as to form the upper and lower plies of the fabric retainer. The upper and lower plies may be sewn, welded, or glued together at each of the connections so as to form the receptacles. The connections may be X-shaped in order to hold the end turns of the coil springs securely in place. The receptacles are sized so as to receive the end turns of the springs.

The row of springs may be a plurality of aligned individual coil springs which may be knotted or unknotted coil springs. Alternatively, the row of springs may be a continuous band of springs formed of a single length of wire.

The strings of springs of the present invention may be inserted into tubular blocks of fabric and the blocks joined together in order to form a pocketed coil spring assembly. One string of springs is contained within each tubular block. Adjacent blocks may be glued, sewn or joined in any other manner to each other. Adjacent tubular blocks may be joined in any of several different ways as for example, as disclosed in U.S. Pat. No. 5,669,093.

In addition, a spring assembly may be manufactured from a plurality of retainer connected strings of springs by aligning a plurality of such strings of springs in a similar orientation such that the strings of springs are aligned parallel to each other. Such aligned strings of springs may then be joined by supplemental fabric strips or sheets in the top and bottom planes of the assembly. The supplemental fabric strips may extend generally parallel the strings of springs with each supplemental fabric strip being secured to the fabric retainers of two adjacent strings of springs. Alternatively, the supplemental fabric strips may extend generally perpendicular to the strings of springs in the top and bottom planes of the spring assembly. Still yet, whole sheets of fabric in the top and bottom planes of the assembly may be used to secure a plurality of strings of springs to each other, the sheets being secured to the fabric retainers of the strings of springs.

As yet another alternative to creating a spring assembly from a plurality of retainer connected strings of springs, an extension flap may be formed on the first and second fabric retainers of each string of springs. The extension flaps may then be used to join adjacent fabric retainers to each other in order to create a spring assembly. The extension flap of one fabric retainer may be secured to an adjacent fabric retainer in order to join the adjacent strings of springs. Alternatively, an extension flap of one fabric retainer may be secured to the extension flap of an adjacent fabric retainer. But irrespective of how the extension flap is used to join adjacent fabric retainers, the extension flaps may be sewn, glued or welded to the fabric of an adjacent fabric retainer to join the fabric retainers and, therefore, join adjacent strings of springs.

Thus, by using either supplemental fabric strips, sheets of fabric or fabric retainers having extension flaps, or strings of springs contained in tubular blocks, any number of strings of springs can be joined together quickly and inexpensively in order to form the desired size spring assembly. These and other objects and advantages of the invention of this application will become more readily apparent from the following description of the drawings.

BRIEF DESCRIPTION OF THE DRAWINGS

FIG. 1A is a perspective view of one embodiment of the string of springs of the present invention;

FIG. 1B is a cross-sectional view taken along line 1B—1B of the string of springs of FIG. 1A;

DETAILED DESCRIPTION OF THE DRAWINGS

Figure 2A:
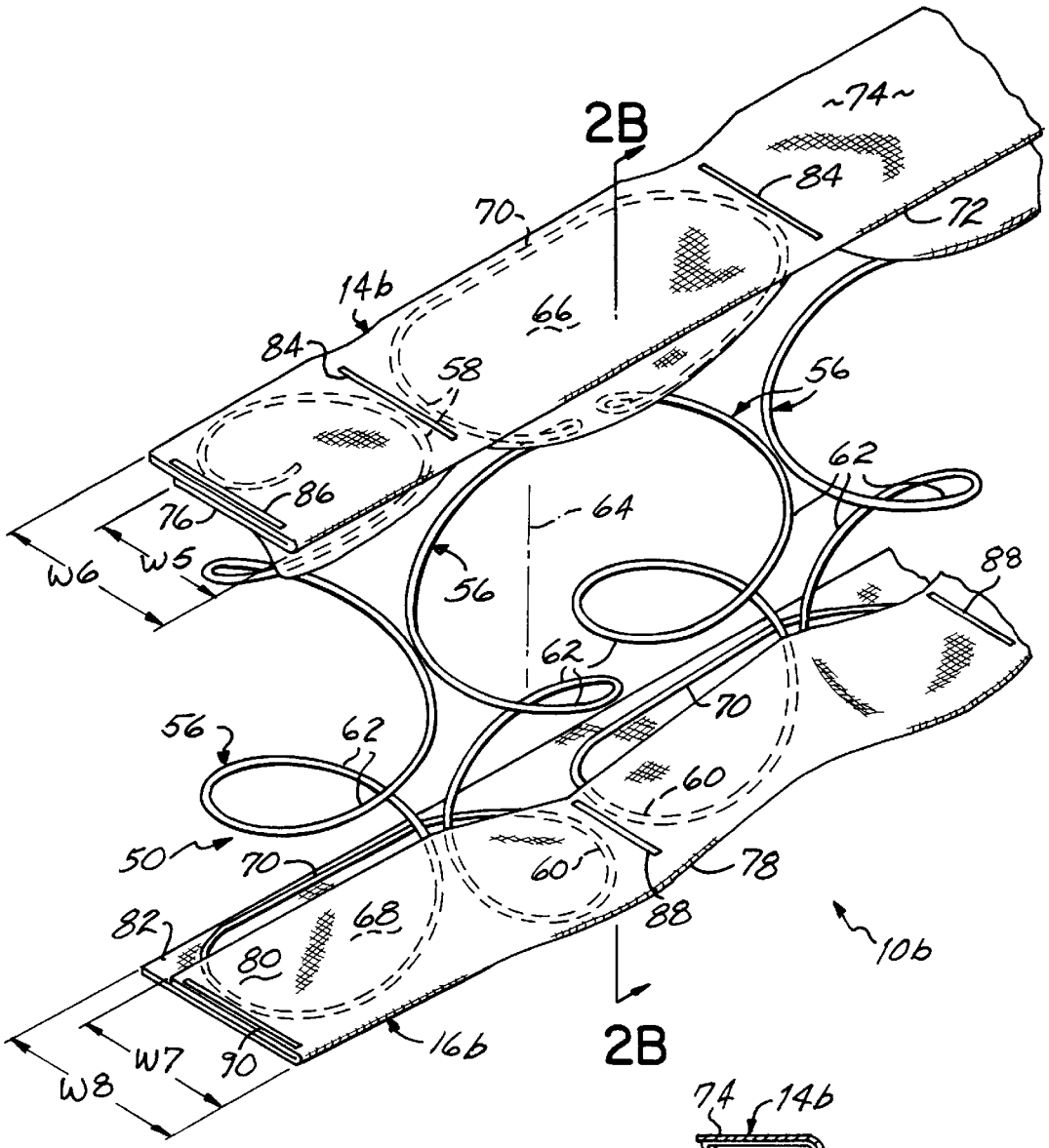
FIG. 2A is a perspective view of a second embodiment of the string of springs of the present invention.

Referring to the drawings, and particularly to FIG. 1A, there is illustrated a string of springs 10. For purposes of this application, the numeral 10 will designate a string of springs generally and different letters following the numeral 10 will designate different embodiments of the string of springs. For example, numeral 10*a* will designate the embodiment of string of springs illustrated in FIGS. 1A and 1B, numeral 10*b* will designate the string of springs illustrated in FIGS. 2A and 2B, numeral 10*c* the string of springs illustrated in FIG. 7A, numeral 10*d* the string of springs illustrated in FIGS. 7B and 7C, numerals 10*e* and 10*e*' the embodiments illustrated in FIGS. 8A and 9A respectively, and numerals 10*f* and 10*f*' the embodiments illustrated in FIGS. 8B and 9B respectively.

Turning now to FIGS. 1A and 1B, the first embodiment of the string of springs will be described. The string of springs 10*a* comprises a row 12 of springs 13, a first fabric retainer 14*a* and a second fabric retainer 16*a*. The row 12 of springs 13 is located between the first and second fabric retainers 14*a*, 16*a* and engaged therewith in a manner described hereinbelow.

The first fabric retainer 14*a* has an upper ply 18 and a lower ply 20. The first fabric retainer 14*a* is illustrated as being a continuous piece of fabric folded longitudinally along fold line 19. However, the first fabric retainer 14*a* need not be formed of a single sheet of material but may comprise two or more sheets secured together as will be described in more detail hereinbelow. The width W1 of the lower ply 20 is less than the width W2 of the upper ply 18 so as to facilitate the insertion and reception of the row 12 of springs 13.

Similarly, the second fabric retainer 16*a* is formed by folding a piece of fabric over upon itself along fold line 21 so as to create an upper ply 22 and a lower ply 24. The width W3 of the upper ply 22 is less than the width W4 of the lower ply 24 so as to facilitate the insertion and retention of the springs 13 in the second fabric retainer 16*a*.

The upper and lower plies of the first and second fabric retainers 14*a*, 16*a* are secured together with connections 26, 27. In FIG. 1A, the connections 26 are illustrated as being X-shaped, each connection 26 comprising a first connection line 28*a* and a second connection line 28*b*, the connection lines 28*a* and 28*b* converging at a point 30. The X-shaped connections 26 define a plurality of receptacles 32 in first fabric retainer 14*a*, each receptacle 32 being located between a pair of adjacent connections 26, 27. Each fabric retainer 14*a*, 16*a* has two outermost connections 27 which are linear rather than X-shaped.

Similarly, receptacles 34 are formed in second fabric retainer 16*a* by joining the upper and lower plies 22, 24 with X-shaped connections 26 and outer connections 27. A pair of adjacent connections define a receptacle 34 therebetween.

In the embodiment of string of springs 10*a*, the row 12 of springs comprises a plurality of aligned, spaced individual coil springs 13. As illustrated in FIGS. 1A and 1B, each individual coil spring 13 has an upper end turn 38, a lower end turn 40 and a plurality of central convolutions 42 located between the upper and lower end turns. The central convolutions 42 of each coil spring 13 define a coil spring axis 44. The coil springs 13 are illustrated as being bonnel springs having knotted upper and lower end turns. However, the invention of this application is not intended to be limited to coil springs or springs having knotted end turns. In other words, any spring may be used in accordance with the present invention.

The upper end turns 38 of the coil springs 13 are located inside the receptacles 32 formed in the first fabric retainer 14*a* and the lower end turns 40 of the coil springs 13 are located in the receptacles 34 formed in the second fabric retainer 16*a*. With the central convolutions 42 of coil springs 13 located between the first and second fabric retainers 14*a*, 16*a* and the end turns 38, 40 of the coil springs 13 located within the receptacles 32, 34, the coil springs 13 are stabilized or held in place by the connections 26, 27.

Each connection 26, 27 joins an upper ply to a lower ply in one of the fabric retainers between the end turns of coil springs creating a receptacle, pocket or cavity. The connections 26, 27 may be sewn lines, glued lines or welded lines. Alternatively, the connections 26, 27 may be staples or any other type of device used to connect adjacent upper and lower plies of a fabric retainer. The connections 26, 27 are spaced from one another such that one end turn 38, 40 of one coil spring 13 is located between an adjacent pair of connections. However, although not shown, there could be multiple end turns of multiple springs between adjacent connections. Endmost connections 27 prevent the outermost coil springs from separating from the fabric retainers. There are two endmost or outer connections 27 in each fabric retainer.

Figure 2B:
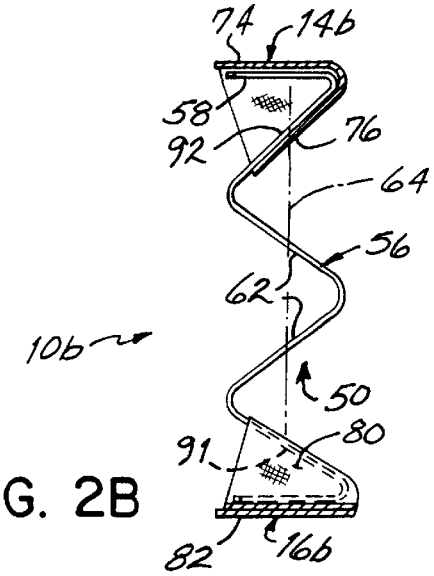
FIG. 2B is a cross-sectional view taken along the line 2B—2B of the string of springs of FIG. 2A.

An alternative embodiment of the string of springs is illustrated in FIGS. 2A and 2B. This embodiment of string of springs 10*b* of the present invention incorporates a band of springs 50, a first fabric retainer 14*b* and a second fabric retainer 16*b*. As illustrated in FIG. 2A, a band of coils springs 50 may be utilized as an alternative to the row 12 of individual coil springs 13 illustrated in FIGS. 1A and 1B. The band of coil springs 50 comprises a plurality of aligned coil springs 56 made of a single length of wire, the coil springs 56 being arranged in a longitudinally extending row. Each coil spring 56 has an upper end turn 58, lower end turn 60 and a plurality of central convolutions 62 located between the upper and lower end turns. The central convolutions 62 of each coil spring 56 define a coil spring axis 64. The band of coil springs 50 has a top face 66 and a bottom face 68, the upper end turns 58 being located in the top face 66 of the band and the lower end turns 60 being located in the bottom face 68 of the band (see FIG. 2A). Adjacent end turns are connected by interconnecting segments 70 located in the top and bottom faces 66, 68 of the band (see FIG. 2A). A more complete description of the band of springs 50 may be found in U.S. Pat. No. 5,127,635, the disclosure of which is hereby fully incorporated by reference.

The first fabric retainer 14*b* is similar to the first fabric retainer 14*a* illustrated in FIG. 1A. Likewise, the second fabric retainer 16*b* is similar to the second fabric retainer 16*a* illustrated in FIG. 1A. The only difference between these fabric retainers is that the connections are linear in the embodiment illustrated in FIG. 2A rather than X-shaped as illustrated in the embodiment illustrated in FIG. 1A. First fabric retainer 14*b* comprises a sheet of fabric folded along a first fold line 72 so as to create an upper ply 74 and a lower ply 76. The width of the lower ply 76 W5 is illustrated as being slightly less than the width W6 of the upper ply 74. However, these widths may be identical or the width of the lower ply greater than the width of the upper ply. Although the upper and lower plies 74, 76 are illustrated as being formed of one sheet of material, they alternatively may be formed of different pieces of material. Similarly, second fabric retainer 16*b* is folded along a longitudinally extending fold line 78 so as to form an upper ply 80 and a lower ply 82. The upper ply 80 is illustrated as having a width W7 less than the width W8 of the upper ply. However, these widths may be identical or the upper ply wider than the lower ply.

Upper and lower plies 74, 76 of the upper or first fabric retainer 14*b* are joined with connections 84, 86. Connections 84 are located between two outermost connections 86 (only one is shown). Similarly, the upper and lower plies, 80, 82 of the second fabric retainer 16*b* are joined with connections 88, 90. The internal connections 88 are located between two outermost connections 90 (only one is shown). Although the connections 84, 86, 88, 90 are illustrated as being linear, they may be alternatively configured as well. These connections may be glue lines, sewn lines, weld lines, staples or any other attachment mechanism. As seen in FIG. 2A, the end turns of two adjacent coil springs are located between adjacent connections except for the endmost end turns.

As illustrated in FIGS. 2A and 2B, with connections 88, 90 securing the upper ply 80 to the lower ply 82 in the second fabric retainer 16*b*, a portion of the upper ply 80 of fabric rides upwardly over a portion 91 of the central convolutions 62 of the coil springs 56 so that the upper ply 80 has a generally inverted V-shaped configuration between adjacent connections 88, 90 (see FIG. 2B). Similarly, the lower ply 76 of the first fabric retainer 14*b* extends downwardly from the connections 84, 86, covers a portion 92 of the central convolutions 62 of the coil springs 56 and has a generally V-shaped configuration between adjacent connections. This configuration of fabric retainers is best illustrated in FIG. 2B.

With this configuration of fabric retainer, fabric covers the upper and lower end turns of the coil springs limiting the noise or friction between coil springs and resulting in a softer, quieter product.

Figure 3:
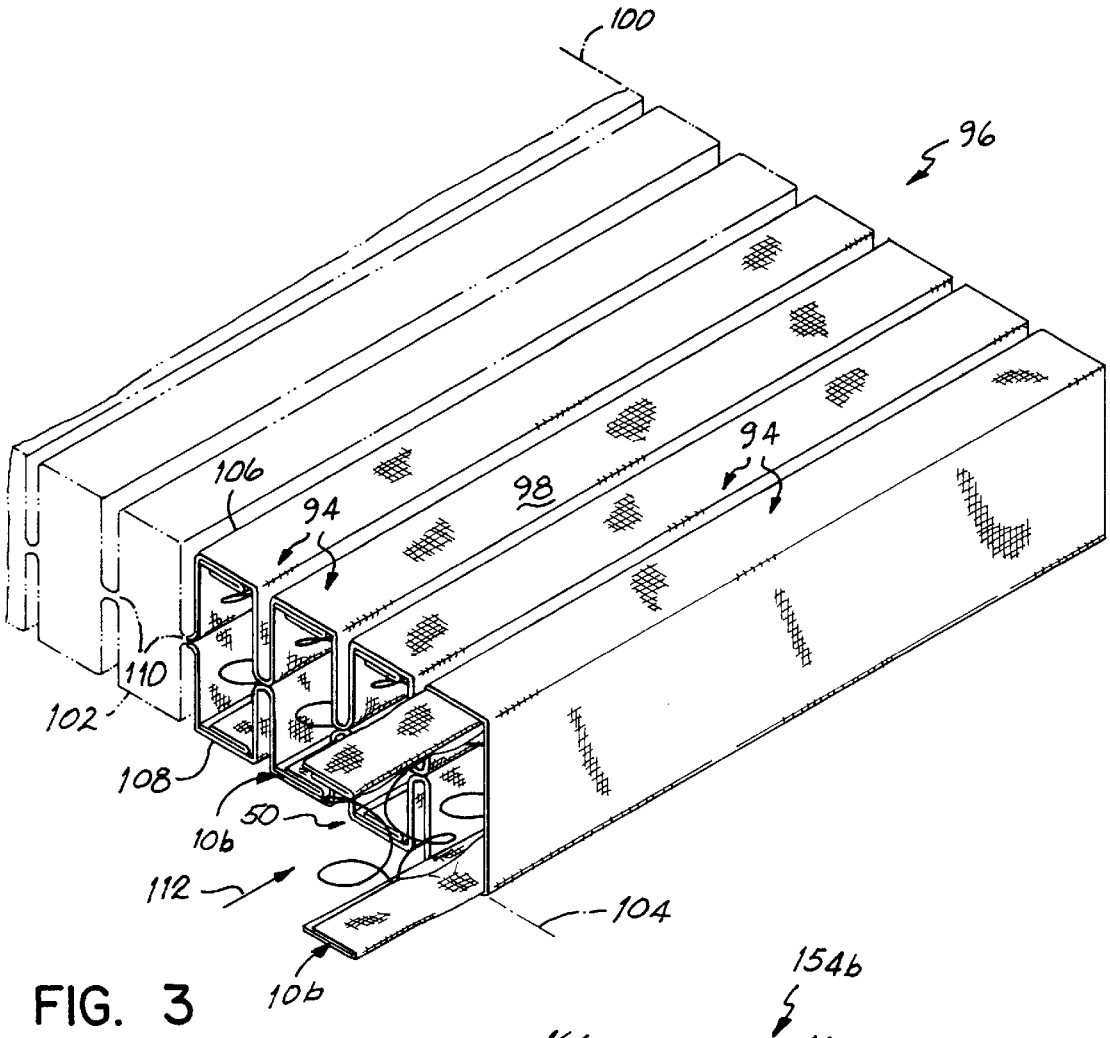
FIG. 3 is a partially disassembled perspective view of a partial pocketed spring assembly incorporating multiple strings of springs.

Referring to FIG. 3, a partial pocketed spring assembly 96 is illustrated. Such a pocketed spring assembly is created by inserting strings of springs 10 into individual blocks 94 of fabric and joining the blocks 94 together so as to create a pocketed spring product. Although FIG. 3 illustrates a string of springs 10*b* being inserted into a block 94, string of springs 10*a* or any other type of string of springs in accordance with the present invention may be utilized as well.

The pocketed spring assembly 96 may be made with all of the strings of springs inserted into the blocks 94 being identical, i.e. the same embodiment of string of springs. Alternatively, several of each embodiment of string of springs 10*a*, 10*b* may be placed in either a random pattern inside the blocks 94 or in a specific pattern, i.e., every other string of springs being the embodiment 10*b* illustrated in FIGS. 2A and 2B while the remainder of strings of springs comprise the embodiment 10*a* illustrated in FIGS. 1A and 1B. Any of the embodiments of strings of springs disclosed in this application may be used in any arrangement or pattern inside blocks 94.

As illustrated in FIG. 3, the pocketed spring assembly 96 has a planar upper surface 98 in a top plane 100 and a planar lower surface 102 in a bottom plane 104. The pocketed spring assembly 96 may be used in the manufacture of bedding or seating products. If utilized for a bedding product, the pocketed spring assembly 96 may have a longitudinal dimension and a transverse dimension, the longitudinal dimension being greater than the transverse dimension. As illustrated in FIG. 3, the blocks 94 may extend transversely or alternatively may extend longitudinally, although this alternative embodiment is not illustrated.

The blocks 94 may be joined by gluing, welding or sewing adjacent blocks to each other. Blocks 94 may be defined between a first sheet of fabric 106 and a second sheet of fabric 108 by spaced lines of attachment 110. Adjacent blocks 94 may be hingedly connected to each other by a transversely extending line of attachment 110, as illustrated in FIG. 3. Each block 94 has a string of springs 10 therein inserted in the direction of arrow 112 between the first and second sheets of fabric 106, 108. Although not illustrated, the blocks and lines of attachment joining adjacent blocks may extend longitudinally as well.

One method by which the pocketed spring assembly 96 of FIG. 3 may be made is to form a first fabric block 94 and insert a first string of springs 10 into the first fabric block 94. Similarly, a second fabric block is created and a second string of springs inserted into the second fabric block. Once the first and second fabric blocks are formed, the blocks may be attached to each other by sewing, gluing or any other means of attaching adjacent blocks. This process may be repeated with multiple blocks until the appropriate length of spring assembly is obtained.

Another method by which the pocketed spring assembly 96 of FIG. 3 may be made is to vertically space first and second sheets of fabric apart from each other. The first and second sheets are connected along one end edge of the spring assembly. A first string of springs is inserted between the first and second sheets. The sheets of fabric are then secured together along a line of attachment to form a first block, the first block containing the first string of springs. A second string of springs is then inserted between the sheets adjacent the first line of attachment. The first and second sheets are joined together along a second line of attachment. This process is repeated until the appropriate length of spring assembly is obtained. This method is generally described in U.S. Pat. No. 5,761,784 incorporated by reference herein albeit not with the use of strings of springs. As illustrated in FIG. 3, the lines of attachment 110 may be located between the top and bottom planes (between the upper and lower planar surfaces of the spring assembly). Alternatively, the lines of attachment may be located in the top and bottom planes as described in U.S. Pat. Nos. 5,669,093 and 5,761,784. If the lines of attachment are located alternatively in the top and bottom planes of the spring assembly, the blocks may be folded accordion-like style and connected with fasteners (not shown) so as to obtain a pocketed spring assembly which may be used in a bedding or seating product.

Referring now to FIGS. 4A–5A, there is illustrated another use for the string of springs of the present invention to construct a bedding or seating product. A plurality of strings of springs 10 may be incorporated into a spring assembly by aligning a plurality of strings of springs 10 in a parallel manner such that each string of springs is similarly oriented. In other words, the fabric retainers of each string of springs are all oriented the same way. Once the strings of springs are so oriented, they are joined together with supplemental fabric strips 116, 118 to form a spring assembly. For purposes of clarification, all spring assemblies constructed with supplemental fabric strips will have identically numbered parts with different letters designating different embodiments.

Figure 4A:
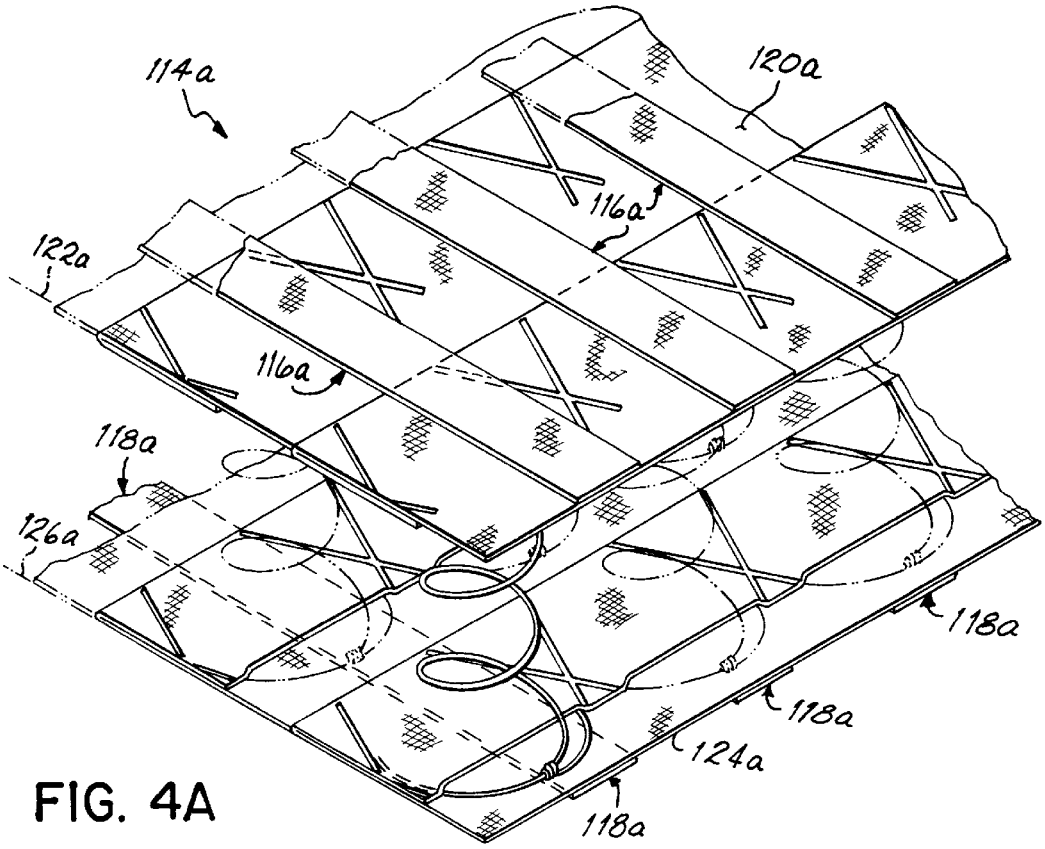
FIG. 4A is a perspective view of a partial spring assembly made by combining multiple strings of springs with supplemental fabric strips, the supplemental fabric strips extending perpendicular to the longitudinal dimension of the strings of springs.

FIG. 4A illustrates one embodiment of spring assembly 114*a* having a planar upper surface 120*a* in a top plane 22*a* and a planar lower surface 124*a* in a bottom plane 126*a*. The spring assembly 114*a* comprises a plurality of similarly aligned strings of springs 10*a* (the embodiment of string shown in FIG. 1A). The strings of springs 10*a* are connected to each other with spaced supplemental fabric strips 116*a*, 118*a*. The supplemental fabric strips 116*a* are located in the top plane 122*a* and the supplemental fabric strips 118*a* are located in the bottom plane 126*a*.

Figure 4B:
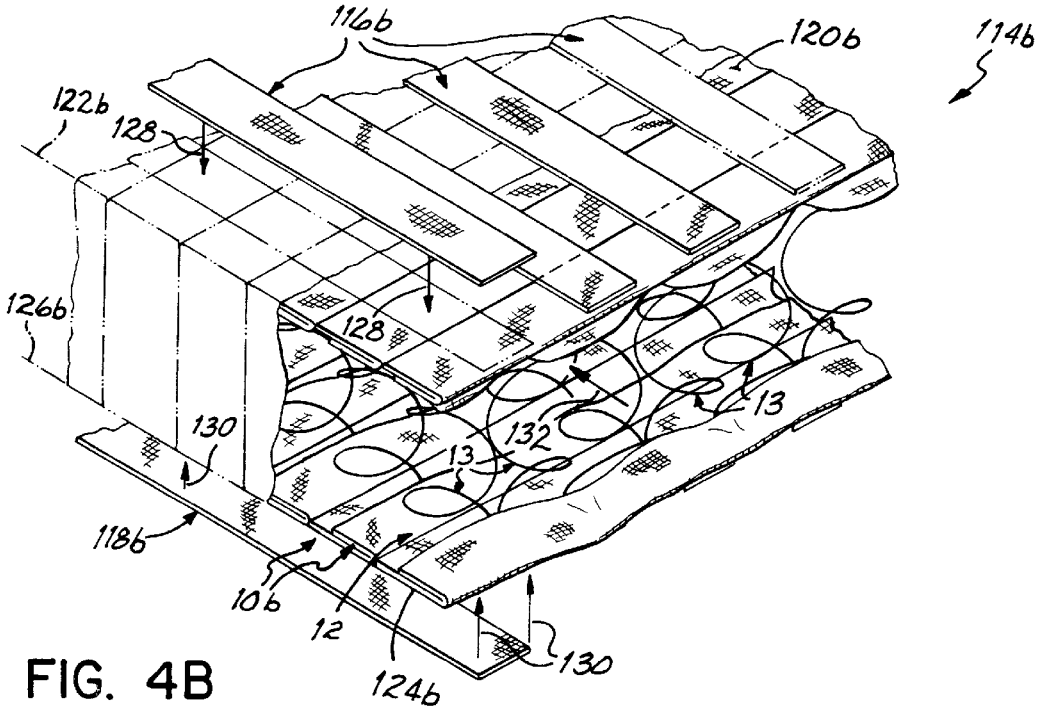
FIG. 4B is a partially disassembled perspective view of a partial spring assembly like that of FIG. 4A but having strings of springs with bands of springs rather than individual springs.

FIG. 4B illustrates another embodiment of spring assembly 114*b* having a planar upper surface 120*b* in a top plane 122*b* and a planar lower surface 124*b* in a bottom plane 126*b*. The spring assembly 114*b* comprises a plurality of similarly aligned strings of springs 10*b* (the embodiment of string shown in FIG. 2A). The strings of springs 10*b* are connected to each other with spaced supplemental fabric strips 116*b*, 118*b*. The supplemental fabric strips 116*b* are located in top plane 122*b* and the supplemental fabric strips 118*b* are located in bottom plane 126*b*.

As illustrated in FIGS. 4A and 4B, the supplemental fabric strips 116*a*, 116*b*, 118*a*, 118*b* extend perpendicular to the longitudinal dimension of the strings of springs 10 so that if the strings of springs 10 are transversely oriented in a bedding product extending the width of the bedding product, i.e., from one side to the other side, the supplemental fabric strips 116*a*, 116*b* and 118*a*, 118*b* would extend longitudinally. The supplemental fabric strips 116*a*, 116*b* and 118*a*, 118*b* are spaced apart from one another and may extend either the full length or width of the bedding or seating product depending on the orientation of the supplemental fabric strips. The supplemental fabric strips 116, 118 may be attached to the fabric retainers by sewing, welding or gluing or any other conventional fastening means. Although FIGS. 4A and 4B illustrate the supplemental fabric strips 116*a*, 116*b* and 118*a*, 118*b* being spaced apart from one another in both the top and bottom planes 122*a*, 122*b* and 126*a*, 126*b* the supplemental fabric strips may be immediately adjacent one another as well.

FIG. 4B illustrates two methods by which any spring assembly comprising a plurality of strings of springs may be constructed. In one method, the desired number of strings of springs are aligned or lined up. Upper supplemental fabric strips 116*b* are then lowered in the direction of arrows 128 and secured to the upper ply of the first fabric retainers. Similarly, lower supplemental fabric strips 118*b* are moved upwardly in the direction of arrows 130 and secured to the lower plies of the second fabric retainers.

A second method of constructing a spring assembly made up of strings of springs is also illustrated in FIG. 4B. Using this method an operator (person or machine) inserts one strings of springs at a time in the direction of arrow 132 and secures a portion of the upper and lower supplemental fabric strips to each additional string of springs after it has been inserted. This process is repeated until the desired length of spring assembly is obtained.

Figure 5A:
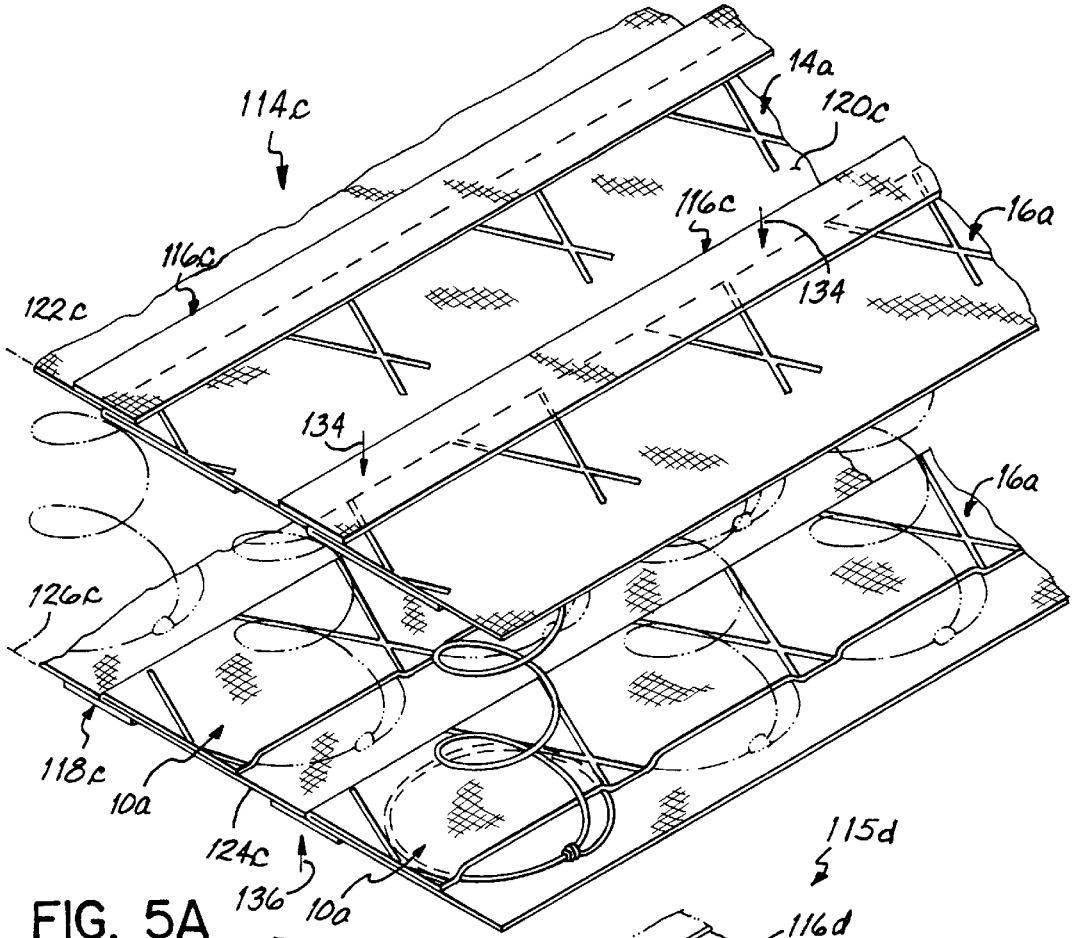
FIG. 5A is a perspective view of a partial spring assembly made of a plurality of strings of springs joined by supplemental fabric strips, the supplemental fabric strips extending generally parallel the longitudinal dimension of the string of springs.

FIG. 5A illustrates an alternative spring assembly 114*c* made of a plurality of strings of springs 10*a* joined with supplemental fabric strips 116*c*, 118*c*. In this spring assembly 114*c*, a plurality of strings of springs 10*a* are aligned so that all the strings of springs 10*a* and, hence, all the first and second fabric retainers are similarly oriented. The strings of springs 10*a* used to make the spring assembly 114*c* are all approximately the same height so that the the first fabric retainers 14*a* lie in a common top plane 122*c* and the second fabric retainers 16*a* lie in a common bottom plane 126*c*. The spring assembly 114*c* has an upper surface 120*c* and lower surface 124*c*.

Supplemental strips 116*c*, 118*c*, respectively are used to secure the strings of springs 10*a* together. The supplemental fabric strips 116*c*, 118*c* extend generally parallel the longitudinal dimension of the strings of springs 10*a*. A portion of each supplemental fabric strip 116*c* lies directly above the upper ply of two adjacent first fabric retainers 14*a*. Likewise, a portion of each supplemental fabric strip 118*c* lies underneath the lower ply of two adjacent second fabric retainers 16*a*.

Figure 5B:
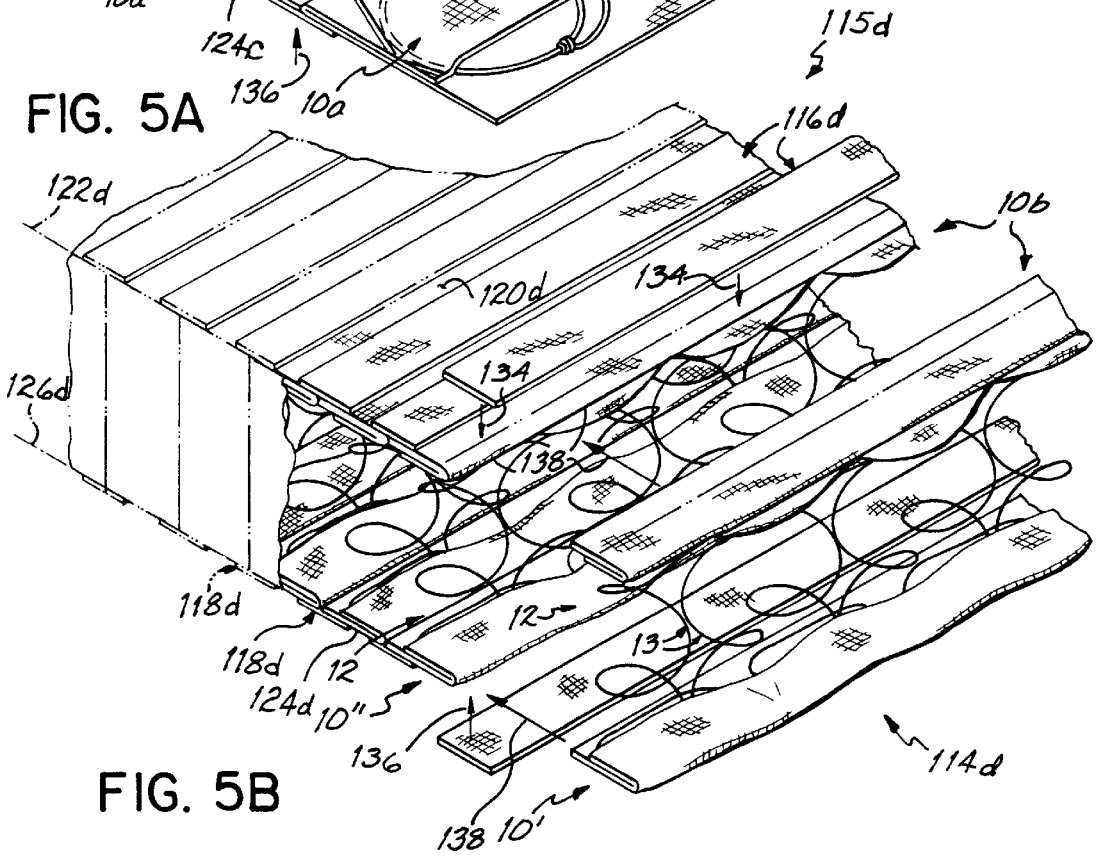
FIG. 5B is a partially disassembled perspective view of a partial spring assembly like that of FIG. 5A but having strings of springs with bands of springs rather than individual springs.

FIG. 5B illustrates an alternative spring assembly 114*d* made of a plurality of strings of springs 10*b* joined together with supplemental fabric strips 116*d*, 118*d*. In this spring assembly 114*d*, the plurality of strings of springs 10*b* are similarly oriented and aligned so that the fabric retainers of each string of springs are similarly oriented. The spring assembly 114*d* has an upper surface 120*d* located in a top plane 122*d* and a lower surface 124*d* located in a bottom plane 126*d*. The supplemental fabric strips 116*d* and 118*d* lie in the top and bottom planes 122*d*, 126*d* respectively of the spring assembly. As with spring assembly 114*c*, the supplemental fabric strips 116*d*, 118*d* extend parallel the longitudinal dimension of the strings of springs 10*b*. A portion of each supplemental fabric strip 116*d* lies directly above the upper ply of two adjacent first fabric retainers and is secured thereto. Likewise, a portion of each supplemental fabric strip 118*d* lies underneath the lower ply of the two adjacent second fabric retainers and is secured thereto.

Preferably the supplemental fabric strips 116, 118 extend the full longitudinal dimension of the strings of springs. However, it is within the purview of the invention of this application that the supplemental fabric strips 116, 118 be cut into pieces and multiple pieces used to connect adjoining strings of springs.

Referring to FIG. 5B, the method by which the spring assemblies 114*c*, 114*d* may be constructed will be described.

First, the desired number of strings of springs (either 10*a* or 10*b*) are aligned and similarly oriented. Then upper supplemental fabric strips 116*d* are lowered in the directions of arrows 134 and a portion of each upper supplemental fabric strip 116*d* secured to two adjacent first fabric retainers. Similarly, lower supplemental fabric strips 118*d* are raised in the direction of arrows 136 and secured to the second fabric retainers of the spring assembly 114*d*.

An alternative method of construction is also illustrated in FIG. 5B. Using this method, the strings of springs may be added one at a time to a group of strings of springs or partial spring assembly 115*d* until an appropriate length or width of spring assembly is obtained. A new string of springs 10' is moved from right to left in the direction of arrows 138. When the string of springs 10' comes into a position immediately adjacent string of springs 10", upper supplemental fabric strip 116*d* is moved downwardly in the direction of arrows 134 and supplemental fabric strip 118*d* moved upwardly in the direction of arrows 136. The supplemental fabric strips 116, 118 may again be joined by sewing, welding, gluing or any other attachment method to the adjoining fabric retainers of the adjacent strings of springs.

Figure 6A:
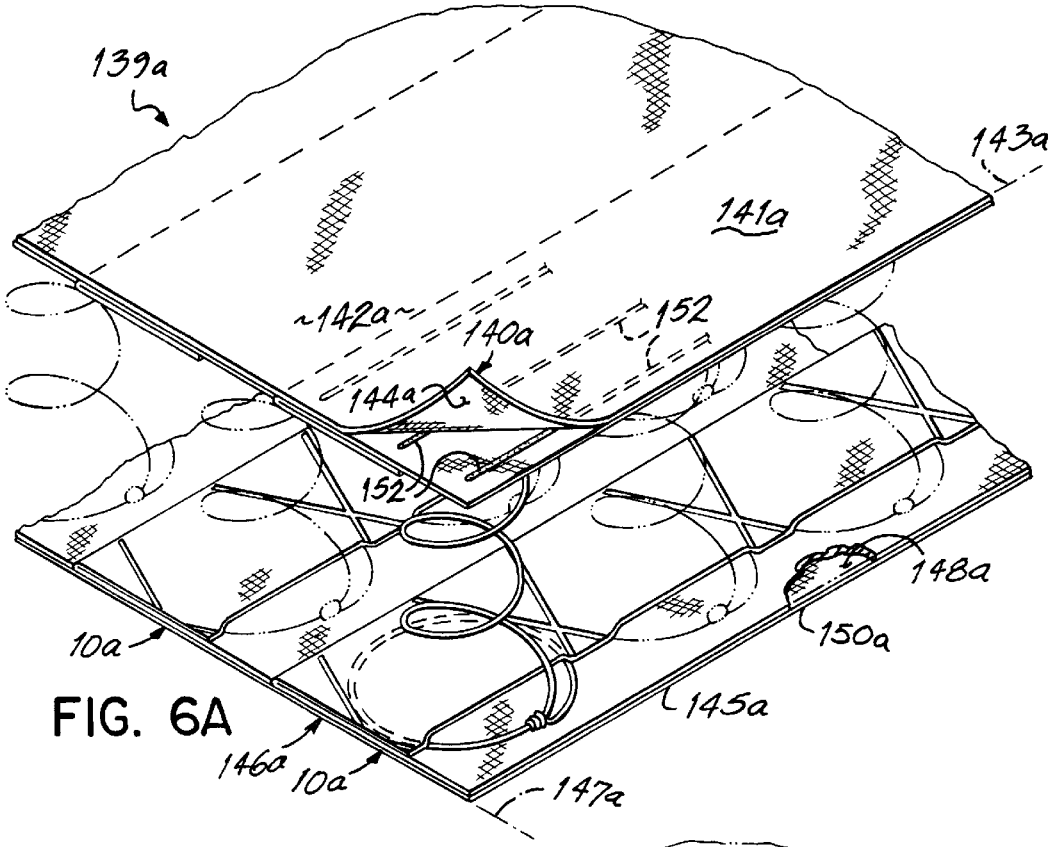
FIG. 6A is a partially disassembled perspective view of a partial spring assembly made by combining multiple strings of springs with upper and lower sheets.
Figure 6B:
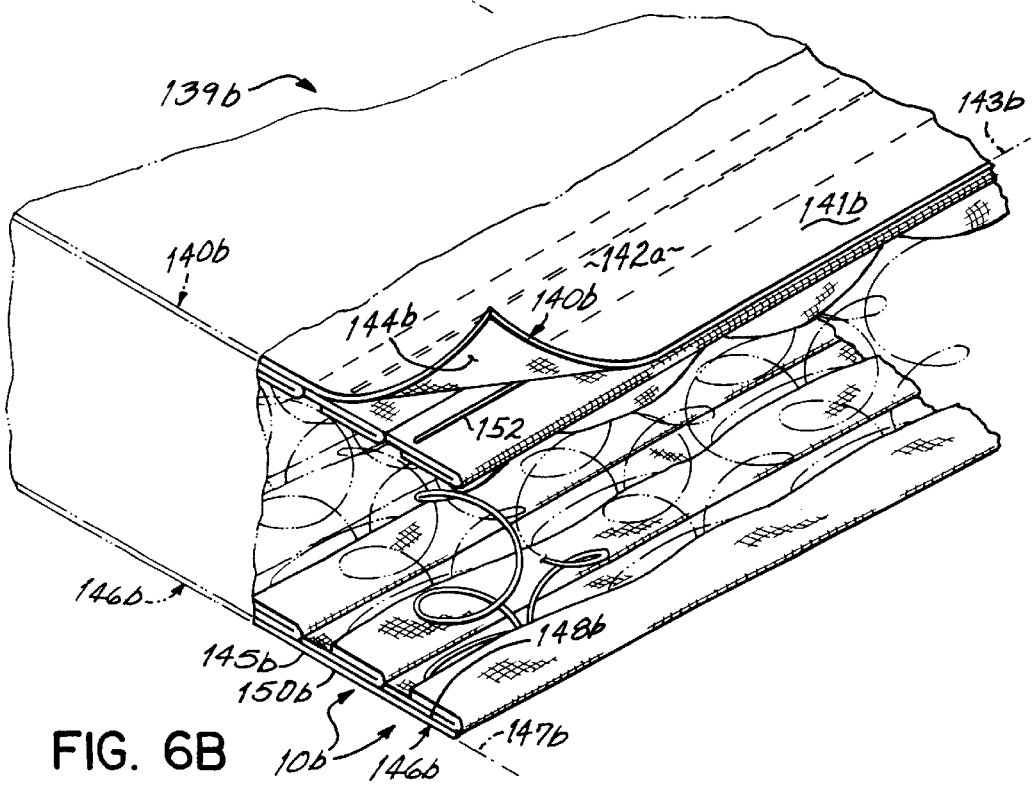
FIG. 6B is a partially disassembled perspective view of a partial spring assembly like that of FIG. 6A but having strings of springs with bands of springs rather than individual springs.

Referring to FIGS. 6A and 6B, alternative embodiments of spring assemblies are illustrated. These embodiments of spring assemblies are similar to the embodiments illustrated in FIGS. 4A–5B in which supplemental fabric strips are utilized to hold a plurality of strings of springs similarly oriented in an assembled relationship to form a spring assembly. However, in the embodiments of FIGS. 6A and 6B, rather than utilizing supplemental fabric strips, at least one sheet is secured to the fabric retainers of the strings of springs in order to hold the strings of springs together.

Again, like parts will be similarly numbered but with different letters designating different embodiments. FIG. 6A illustrates a spring assembly 139*a* comprising a plurality of similarly aligned strings of springs 10*a*. The spring assembly 139*a* has a planar upper surface 141*a* in a top plane 143*a* and a planar lower surface 145*a* located in a bottom plane 147*a*. An upper sheet 140*a* is placed on top of the plurality of similarly aligned strings of springs. The upper sheet 140*a* has an upper surface 142*a* and a lower surface 144*a*. The lower surface 144*a* of the upper sheet 140*a* abuts against and is secured to the upper plies of the fabric retainers of the strings of springs 10*a*. Similarly, a lower sheet 146*a* having an upper surface 148*a* and a lower surface 150*a* is secured to the lower plies of the second fabric retainers of the strings of springs 10*a*.

FIG. 6B illustrates a portion of a spring assembly 139*b* having a planar upper surface 141*b* in a top plane 143*b* and a planar bottom surface 145*b* located in a bottom plane 147*b*. The spring assembly 139*b* comprises a plurality of strings of springs 10*b* similarly aligned and oriented parallel to each other. The strings of springs 10*b* are secured together with upper and lower sheets 140*b*, 146*b*.

These upper and lower sheets 140*a*, 140*b* and 146*a*, 146*b* preferably extend the entire length and width of the spring assembly. However, the upper and lower sheets may have a length or width which is less than or greater than the length and width of the spring assembly. Additionally, more than one sheet may be secured to the first and second fabric retainers, either on top of one another or side-by-side.

In order to secure the upper and lower sheets 140, 146 to the first and second fabric retainers, glue lines 152 are preferably laid parallel to the longitudinal dimension of the strings of springs. Glue, preferably a hot melt glue, is placed between the lower surface 144*a*, 144*b* of the upper sheet 140*a*, 140*b* and the upper ply of the first fabric retainers. Similarly, glue lines (not illustrated) are placed between the lower plies of the second fabric retainers and the upper surface 148*a*, 148*b* of the lower sheet 146*a*, 146*b*. One glue line may secure each string of springs to an upper sheet and a separate glue line may secure the same string of springs to the lower sheet. These glue lines are illustrated as being linear, however, alternative patterns which are non-linear, random, a dashed-line or any other patterns may be utilized as well. Each fabric retainer need not be secured with a glue line to the upper and lower sheets. For example, every other fabric retainer may be glued to the upper and lower sheets. As an alternative to glue, ultrasonic welds, staples, hog rings or other fasteners may be used to secure the upper and lower sheets to the first and second fabric retainers. The upper and lower sheets may be made of the same material as the fabric of the spring retainers, any woven or non-woven fabric, plastic or any other material.

Figure 7C:
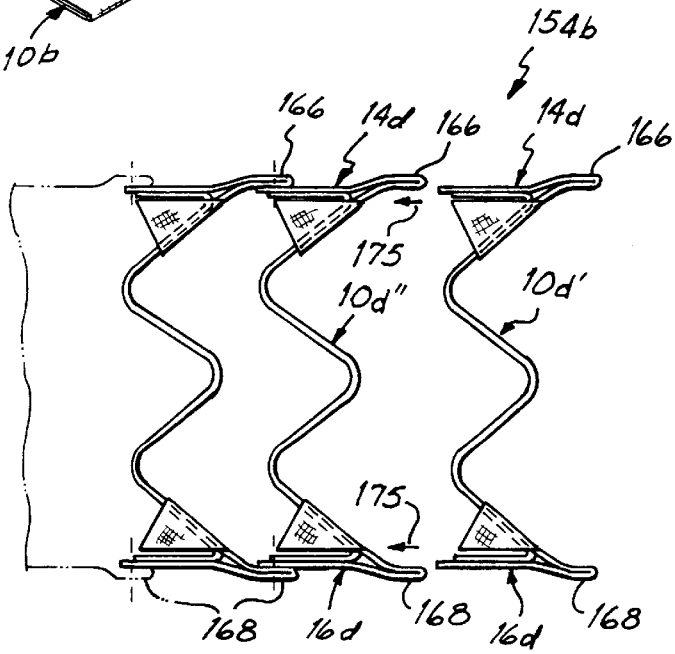
FIG. 7C is a partially disassembled side elevational view of the partial spring assembly of FIG. 7B.
Figure 7A:
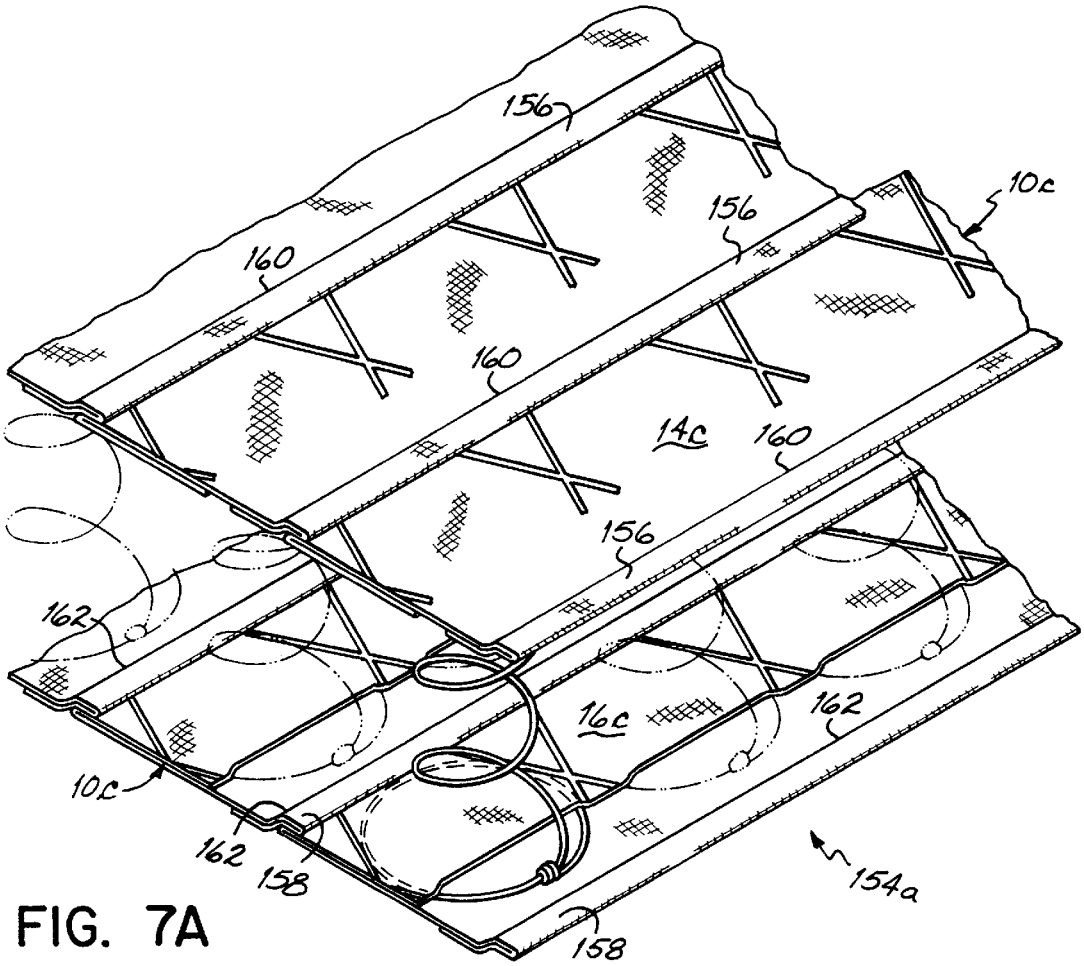
FIG. 7A is a perspective view of a partial spring assembly made with a plurality of aligned strings of springs, the strings of springs having fabric retainers with double ply extension flaps, the extension flaps being joined to the fabric retainers of adjacent strings of springs.
Figure 7B:
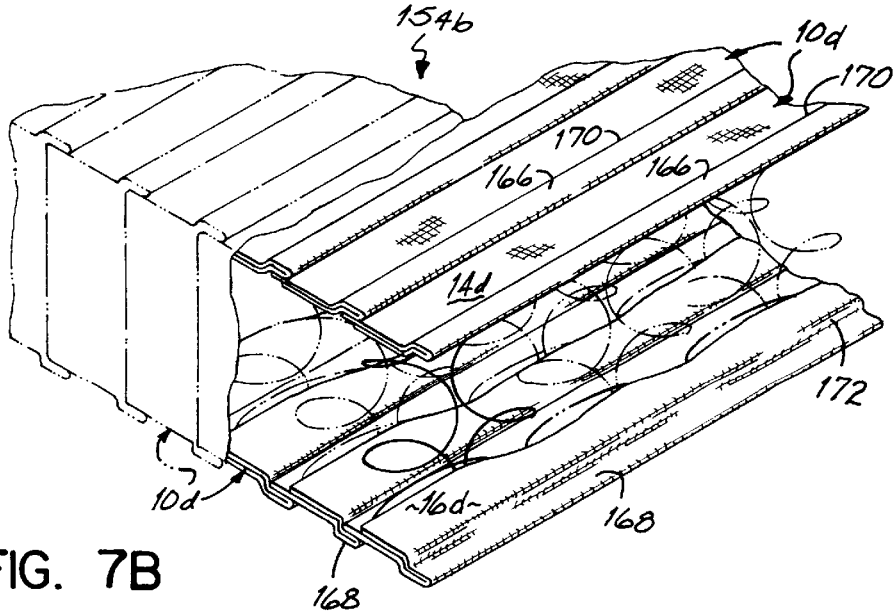
FIG. 7B is a perspective view of a partial spring assembly like that of FIG. 7A but having strings of springs with bands of springs rather than individual springs.

Alternative embodiments of the strings of springs of the present invention are illustrated in FIGS. 7A–7C. These strings of springs are similar to the strings of springs illustrated in FIGS. 1A and 1B but slightly different. More specifically, the first and second fabric retainers of these strings of springs differ from the fabric retainers of the strings of springs illustrated in FIGS. 1A and 1B. These fabric retainers each have a two-ply extension flap formed by joining the upper and lower plies of the fabric retainer with a longitudinally extending seam. The plies may be joined by sewing, gluing or any other method of joining two plies of fabric together.

FIG. 7A illustrates a spring assembly 154*a* made of a plurality of strings of springs 10*c* connected together. The string of springs 10*c* is identical to the string of springs 10*a* illustrated in FIG. 1A except that the first fabric retainer 14*c* has a longitudinally extending first extension flap 156 and the second fabric retainer 16*c* has longitudinally extending second extension flap 158. Extension flap 156 is formed by joining the upper and lower plies of the first fabric retainer 14*c* along a longitudinally extending seam 160. Similarly, extension flap 158 is formed by joining the upper and lower plies of the second fabric retainer 16*c* along a longitudinally extending seam 162. These seams may be weld lines, glue lines, sewn lines or any other form of attachment. The purpose of the extension flaps is to connect adjacent strings of springs together and, more specifically, to connect the adjacent fabric retainers of adjacent strings of springs to each other.

FIG. 7B illustrates a spring assembly 154*b* made up of a plurality of strings of springs 10*d* joined together. Each of the strings of springs 10*d* is similar to the string of springs 10*b* illustrated in FIG. 2B. However, each of the fabric retainers 14*d*, 16*d* has an extension flap 166, 168 respectively formed by longitudinally extending seams 170, 172 respectively formed in the same manner described hereinabove. The first extension flap 166 is formed in the first fabric retainer 14*d* and the second extension flap 168 is formed in the second fabric retainer 16*d*.

FIG. 7C illustrates the method of manufacturing a spring assembly with strings of springs having extension flaps. Although the numerals of FIG. 7C match the numerals of FIG. 7B, the spring assembly 154*a* may be manufactured using the method illustrated in FIG. 7C. As illustrated in FIG. 7C, the first extension flap 166 of each string of springs 10*d* overlies the first fabric retainer 14*d* of an adjacent string of springs 10*d*. Likewise, the second extension flap 168 of string of springs 10*d* lies underneath the second fabric retainer 16*d* of an adjacent string of springs. The fabric retainers of adjacent strings of springs are secured by gluing, sewing or welding along the extension flaps.

To manufacture a spring assembly from strings of springs having extension flaps, one string of springs 10*d*' at a time is moved in the direction of arrows 175 toward string of springs 10*d*" until the extension flaps of fabric retainers of string of springs 10*d*" overlie the fabric retainers of string of springs 10*d*'. The strings of springs 10 are joined together by securing the extension flaps of the fabric retainers of one string of springs to the fabric retainers of an adjacent string of springs by sewing, gluing or welding or any other method. The extension flaps 166, 168 of the strings of springs 10*d*" are secured to the fabric retainers of adjacent strings of springs 10*d*'. FIGS. 7A and 7B illustrate spring assemblies formed by this method.

FIGS. 8A–9B illustrate yet another pair of embodiments of string of springs. In these embodiments of strings of springs, each first and second fabric retainer has two extension flaps. In forming a spring assembly with such strings of springs, the extension flaps of adjacent strings of springs are secured to each other in order to connect adjacent strings of springs.

Figure 8A:
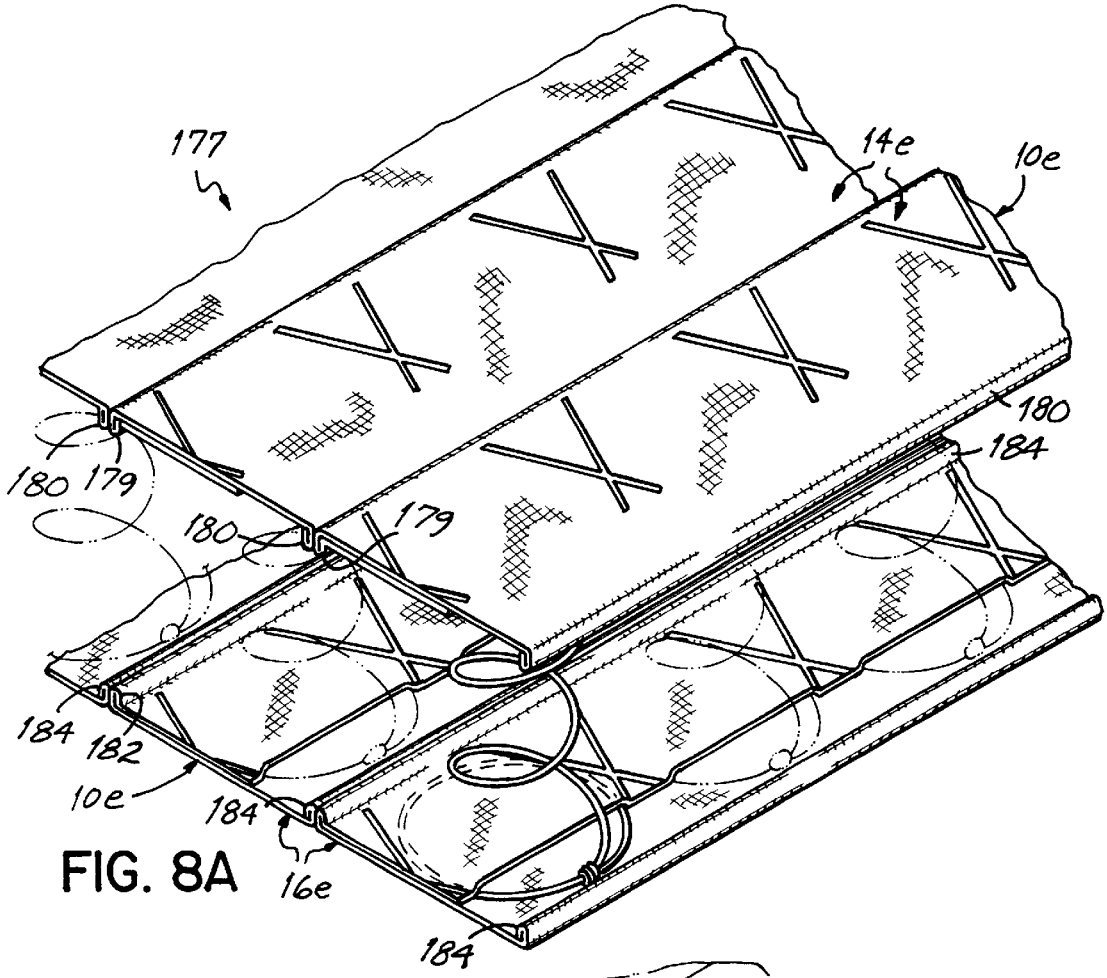
FIG. 8A is a perspective view of a partial spring assembly made of a plurality of aligned strings of springs, the strings of springs having vertically oriented extension flaps inwardly turned.

Referring to FIG. 8A, there is illustrated a spring assembly 177. The spring assembly 177 is formed with a plurality of strings of springs 10*e* joined together. The string of springs 10*e* is similar to the string of springs 10*a* illustrated in FIG. 1A. However, the first and second fabric retainers 14*e*, 16*e* are slightly different than the first and second fabric retainers 14*a*, 16*a* of string of springs 10*a*. The first fabric retainer 14*e* illustrated in FIG. 8A has two extension flaps 179, 180. Similarly, second fabric retainer 16*e* has two extension flaps 182, 184. In order to form the spring assembly 177, the extension flaps 179, 180, 182, 184 are turned inwardly (towards each other) to a generally vertical orientation and sewn, welded, glued or otherwise secured to each other.

Figure 8B:
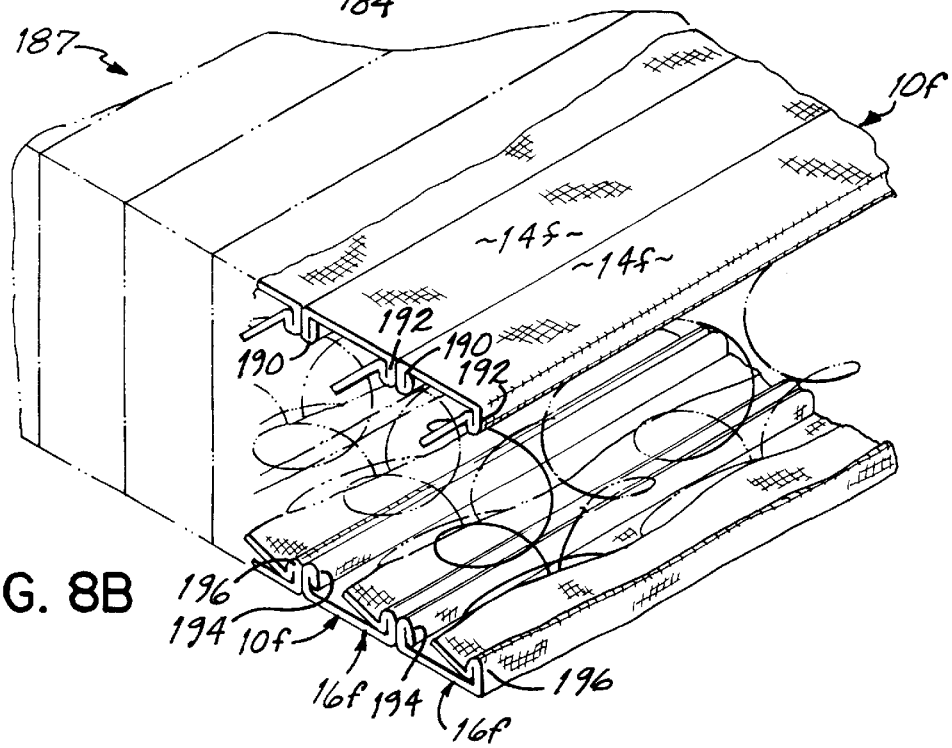
FIG. 8B is a perspective view of a partial spring assembly like that shown in FIG. 8A but having strings of springs with bands of springs rather than individual springs.

Turning now to FIG. 8B, there is illustrated a spring assembly 187 formed by joining a plurality of strings of springs 10*f*. Each string of springs 10*f* is similar to the string of springs 10*b* illustrated in FIG. 2A. However, each string of springs 10*f* has an upper fabric retainer 14*f* having two extension flaps 190, 192. Similarly, second fabric retainer 16*f* has extension flaps 194, 196. In order to join the strings of springs to each other in order to form the spring assembly 187, the extension flaps of adjacent strings of springs are secured together. This securement may be by welding, gluing, sewing or any other fastening means. The extension flaps are turned inwardly and vertically oriented.

Figure 9A:
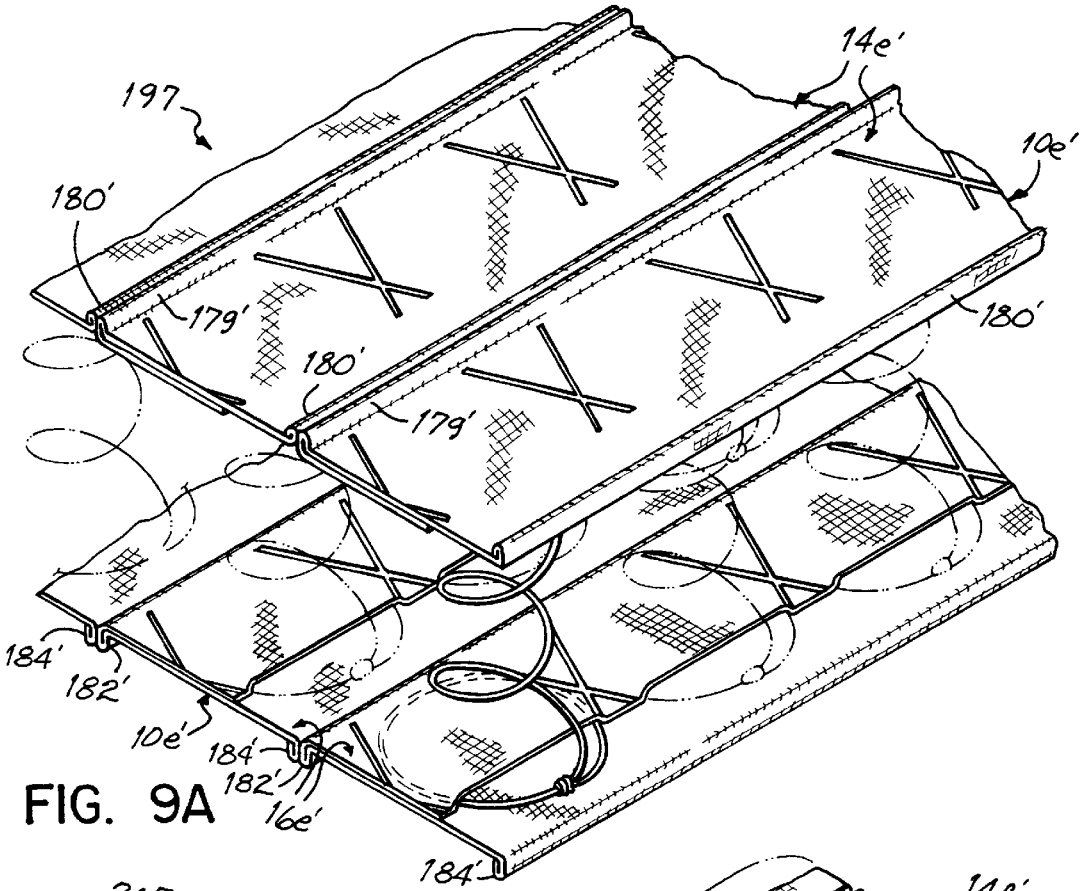
FIG. 9A is a perspective view of a partial spring assembly made of a plurality of aligned strings of springs, the fabric retainers of each string of springs having multiple extension flaps joined together and outwardly turned.

FIG. 9A illustrates yet another spring assembly 197 formed by joining a plurality of strings of springs 10*e*'. Each string of springs 10*e*' has a first fabric retainer 14*e*' and second fabric retainer 16*e*'. The first fabric retainer 14*e*' has two extension flaps 179' and 180'. Similarly the second fabric retainer 16*e*' has two extension flaps 182' and 184'. In order to form the spring assembly 197, the extension flaps 179' and 180' of adjacent fabric retainers 14*e*' are turned outwardly to a generally vertical orientation and sewn, welded, glued or otherwise secured to each other in order to join adjacent fabric retainers. Similarly, the extension flaps 182' and 184' of adjacent fabric retainers 16*e*' are turned outwardly to a generally vertical orientation and sewn, welded, glued or otherwise secured to each other.

Figure 9B:
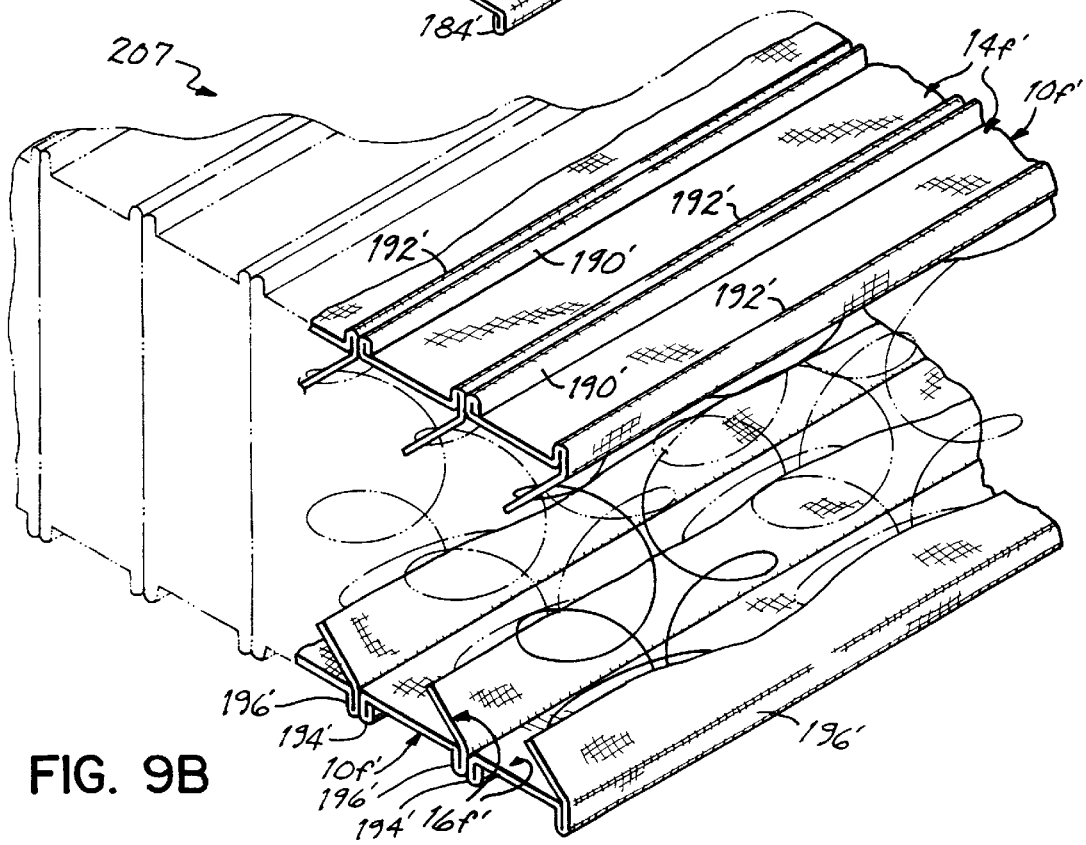
FIG. 9B is a perspective view of a partial spring assembly made up of a plurality of strings of springs, each string having a band of springs rather than individual springs.

FIG. 9B illustrates a spring assembly 207 formed by joining a plurality of strings of springs 10*f*'. Each string of springs 10*f*' has a first fabric retainer 14*f*' and second fabric retainer 16*f*'. The first fabric retainer 14*f*' has two extension flaps 190' and 192'. Similarly the second fabric retainer 16*f*' has two extension flaps 194' and 196'. In order to form the spring assembly 207, the extension flaps 190' and 192' of adjacent fabric retainers 14*f*' are turned outwardly to a generally vertical orientation and sewn, welded, glued or otherwise secured to each other in order to join adjacent fabric retainers. Similarly, the extension flaps 194' and 196' of adjacent fabric retainers 16*f*' are turned outwardly to a generally vertical orientation and sewn, welded, glued or otherwise secured to each other.

While I have described several embodiments of the present invention, persons skilled in the art will appreciate changes and modifications which may be made without departing from the spirit of the invention. Therefore, I do not intend to be limited except by the scope of the following claims.

What is claimed is:

1. A spring assembly for use in the manufacture of bedding and seating products, said spring assembly comprising:

a plurality of blocks hingedly connected together, each block containing a string of springs, said string of springs comprising, a row of springs, each of said springs having an upper and lower end turn, a first fabric retainer having an upper ply and a lower ply, said upper ply and lower ply being joined by multiple, spaced connections defining a receptacle between each pair of adjacent connections, a second fabric retainer having an upper ply and a lower ply, said upper ply and lower ply being joined by multiple, spaced connections defining a receptacle between each pair of adjacent connections, said row of springs being located between said first and second fabric retainers with said end turns of said springs being located within said receptacles wherein the strings of springs within different blocks have different characteristics in order to posturize the spring assembly.

2. A spring assembly for use in the manufacture of bedding and seating products, said spring assembly having an upper and lower planar surface in top and bottom planes respectively and comprising:

a plurality of hingedly connected fabric blocks, each block containing a string of springs, wherein said blocks are defined between two sheets of fabric, a first sheet and a second sheet, each sheet containing a plurality of folds therein, said folds separating said blocks from one another and extending inwardly from one of said upper and lower planar surfaces, said string of springs comprising:

a row of springs, each of said springs having an upper and lower end turn, a first fabric retainer having an upper ply and a lower ply, said upper ply and lower ply being joined by multiple, spaced connections defining a receptacle between each pair of adjacent connections, a second fabric retainer having an upper ply and a lower ply, said upper ply and lower ply being joined by multiple, spaced connections defining a receptacle between each pair of adjacent connections, said row of springs being located between said first and second fabric retainers with said end turns of said springs being located within said receptacles wherein the strings of springs within different blocks have different characteristics in order to posturize the spring assembly.

3. The spring assembly of claim 2 wherein said first and second sheets are joined with lines of attachment.

4. The spring assembly of claim 3 wherein said lines of attachment are located in said upper and lower planar surfaces of said pocketed spring assembly.

5. A method of making a spring assembly having an upper planar surface in a top plane and lower planar surface in a bottom plane, said spring assembly comprising a plurality of integrally connected fabric blocks, each block containing a string of springs which method comprises the steps of:

vertically spacing two sheets of fabric so the sheets are generally parallel, connecting said sheets along one end edge of said spring assembly, inserting a string of springs between said sheets, said string of springs comprising a row of springs, each of said springs having an upper and lower end turn, a first and second fabric retainer, each fabric retainer having an upper ply and a lower ply, said upper ply and lower ply being joined by multiple, spaced connections defining a receptacle between each pair of adjacent connections, said row of springs being located between said first and second fabric retainers with said end turns of said springs being located within said receptacles, securing said sheets together along a line of attachment such that said sheets form a fabric block, said fabric block containing said string of springs, repeating said steps of inserting a string of springs and securing said sheets together wherein different blocks contain strings of springs having different characteristics in order to impart differing degrees of firmness to the spring assembly, connecting said sheets along the other end edge of said spring assembly.

6. The method of claim 5 said step of securing said sheets together along said line of attachment comprises sewing the sheets together.

7. A spring assembly for use in the manufacture of bedding and seating products, said spring assembly comprising:

a plurality of blocks joined together, each block containing a string of springs, said string of springs comprising, a row of springs, each of said springs having an upper and lower end turn, a first fabric retainer having an upper ply and a lower ply, said upper ply and lower ply being joined by multiple, spaced connections defining a receptacle between each pair of adjacent connections, a second fabric retainer having an upper ply and a lower ply, said upper ply and lower ply being joined by multiple, spaced connections defining a receptacle between each pair of adjacent connections, said row of springs being located between said first and second fabric retainers with said end turns of said springs being located within said receptacles wherein the strings of springs within different blocks have different characteristics.

8. A spring assembly comprising:

a plurality of blocks joined together, each block containing a string of springs, said string of springs comprising a row of springs, a first fabric retainer and a second fabric retainer, each of said springs having an upper and lower end turn, each of said fabric retainers having an upper ply and a lower ply, said upper ply and lower ply being joined by multiple, spaced X-shaped connections, each pair of adjacent X-shaped connections defining a receptacle therebetween, said row of springs being located between said first and second fabric retainers with said end turns of said springs being located within said receptacles.

9. The spring assembly of claim 8 wherein the strings of springs within different blocks have different characteristics.

10. A spring assembly comprising:

a plurality of blocks joined together, each block containing a string of springs, said string of springs comprising a band of coil springs made of a single length of wire, a first fabric retainer and a second fabric retainer, each of said coil springs having an upper and lower end turn, each of said fabric retainers having an upper ply and a lower ply, said upper ply and lower ply being joined by multiple, spaced connections, each pair of adjacent connections defining a receptacle therebetween, said band of coil springs being located between said first and second fabric retainers with said end turns of said coil springs being located within said receptacles.

11. The spring assembly of claim 10 wherein the strings of springs within different blocks have different characteristics.

12. A spring assembly for use in the manufacture of bedding and seating products, said spring assembly having an upper and lower planar surface in top and bottom planes respectively and comprising:

a plurality of hingedly connected fabric blocks, said blocks being defined between first and second sheets of fabric by spaced lines of attachment of said sheets to each other, each of said blocks containing a string of springs comprising a row of springs, a first fabric retainer and a second fabric retainer, each of said springs having an upper and lower end turn, each of said fabric retainers having an upper ply and a lower ply, said upper ply and lower ply being joined by multiple, spaced X-shaped connections defining receptacles therebetween, said row of springs being located between said first and second fabric retainers with said end turns of said springs being located within said receptacles.

13. The spring assembly of claim 12 wherein the strings of springs within different blocks have different characteristics.

14. A spring assembly for use in the manufacture of bedding and seating products, said spring assembly having an upper and lower planar surface in top and bottom planes respectively and comprising:

a plurality of hingedly connected fabric blocks, said blocks being defined between first and second sheets of fabric by spaced lines of attachment of said sheets to each other, each of said blocks containing a string of springs comprising a band of springs made of a single length of wire, a first fabric retainer and a second fabric retainer, each of said springs of said band having an upper and lower end turn, each of said fabric retainers having an upper ply and a lower ply, said upper ply and lower ply being joined by multiple, spaced connections defining receptacles therebetween, said row of springs being located between said first and second fabric retainers with said end turns of said springs being located within said receptacles.

15. The spring assembly of claim 14 wherein said lines of attachment are located in said top and bottom planes.

16. The spring assembly of claim 14 wherein each of said strings of springs are identical.

17. The spring assembly of claim 14 wherein some of said blocks have strings of springs which are different that the strings of springs within other of said blocks.

* * * * *